US007034468B2

(12) United States Patent
Kim et al.

(10) Patent No.: US 7,034,468 B2
(45) Date of Patent: Apr. 25, 2006

(54) CHARGE-CONTROLLED DRIVING CIRCUIT FOR PLASMA DISPLAY PANEL

(75) Inventors: Joon-yub Kim, 209-903, Dong-a Apt, 291, Geoyeo-2-dong, Songpa-Gu, Seoul (KR); Yang-Keun Lee, Icheon-si (KR)

(73) Assignee: Joon-yub Kim, Seoul (KR)

( * ) Notice: Subject to any disclaimer, the term of this patent is extended or adjusted under 35 U.S.C. 154(b) by 696 days.

(21) Appl. No.: 10/229,016

(22) Filed: Aug. 28, 2002

(65) Prior Publication Data

US 2003/0160569 A1 Aug. 28, 2003

(30) Foreign Application Priority Data

Feb. 28, 2002 (KR) ..... 2002-0010768

(51) Int. Cl.
*G09G 3/10* (2006.01)

(52) U.S. Cl. ..... 315/169.4; 345/60

(58) Field of Classification Search ..... 315/169.1, 315/169.4; 345/41, 60, 69, 68, 211, 212
See application file for complete search history.

(56) References Cited

U.S. PATENT DOCUMENTS 4,866,349 A * 9/1989 Weber et al. ..... 315/169.4
5,081,400 A 1/1992 Weber et al.
5,642,018 A * 6/1997 Marcotte ..... 315/169.4
5,786,794 A * 7/1998 Kishi et al. ..... 345/60
6,011,355 A * 1/2000 Nagai ..... 315/169.3
6,160,531 A * 12/2000 Chen et al. ..... 345/60
6,538,627 B1 * 3/2003 Whang et al. ..... 345/60
2003/0090440 A1 * 5/2003 Marcotte ..... 345/60

* cited by examiner

*Primary Examiner*—Don Wong
*Assistant Examiner*—Thuy Vinh Tran
(74) *Attorney, Agent, or Firm*—Jacobson Holman PLLC

(57) ABSTRACT

An energy recovery driving circuit is presented with an improved design which the power efficiency is increased by limiting the current during the sustain period of the plasma display panel (PDP). The circuit to be disclosed comprises a storage capacitor; charging device for providing a path of charge-flow when turned on, the charging means being connected to the storage capacitor; a resonance inductor that is connected to the charging device; an intermediate capacitor, connected to the resonance inductor to accomplish a LC resonance with the inductor, wherein the intermediate capacitor is charged up to at least a sustain voltage as a result of the LC resonance. The circuit further comprises switching device, connected between the intermediate capacitor and the panel capacitance, which turns on after the intermediate capacitor is charged to at least the sustain voltage so that the charge stored in the intermediate capacitor is transferred to the panel capacitance and the sustain discharge is fired.

16 Claims, 7 Drawing Sheets

CHARGE-CONTROLLED DRIVING CIRCUIT FOR PLASMA DISPLAY PANEL

BACKGROUND OF THE INVENTION (a) Field of the Invention

This invention relates generally to a circuit for driving an AC plasma display panel, and more particularly, to a charge-limiting energy recovery driving circuit with an improved structure in which the current during the sustain period is limited to obtain higher power efficiency.

(b) Description of the Related Art

A panel structure of a conventional AC PDP is shown in FIG. 1*a*. As shown in the figure, the panel consists of a front glass plate 1 and a rear glass plate 2. On the rear glass plate 2, a plurality of address electrodes A are parallelly disposed. A thin dielectric layer 5 is then placed on top of these address electrodes A, covering the entire surface of the rear glass plate 2. On top of this dielectric layer 5, barrier ribs 3 are formed, creating "cells." In addition, a layer of light-emitting phosphor 4 (red, blue, or green) is applied onto the sidewalls of the barrier ribs 3 and the dielectric layer 5.

On the front glass plate 1, a plurality of scan electrodes Y and a plurality of sustain electrodes X are formed. The scan electrodes and the sustain electrodes are parallelly aligned, but perpendicular to the aforementioned address electrodes A of the rear glass plate 2, forming a grid. Much like the rear glass plate 2, a dielectric layer 8 is then placed on top of the electrodes X and Y, covering the entire surface of the front glass plate 1. A thin MgO layer 9 is then placed on top of this dielectric layer 8.

An AC PDP is then created by combining these two glass plates 1 and 2 together, evacuating the space between the two plates 1 and 2, and filling this gap with a mixture of rare gases (typically Xe—Ne).

As in FIG. 1*b*, each of the discharge cells is formed at each of the intersections of each of the scan electrodes and each of the sustain electrodes of the front glass plate 1 and each of the address electrodes of the rear glass plate 2. Because the aforementioned "cells" on the rear glass plate are coated with red, blue, or green phosphor, full-color images can be obtained.

In the case of an AC PDP (as in FIG. 2), a subfield method is typically employed to realize gradation luminance representations and thus to achieve 256 gray scale.

The subfield method divides one field period into N subfields, each of which is allocated a light emission period (the number of times of light emission) corresponding to a weighting for each bit digit of pixel data (composed of N bits) to drive the PDP to emit light. Each of the subfields consists of a reset period, an address period, and a discharge-sustaining period (a sustain period). In other words, each of the eight subfields mentioned above has one length of the sustain periods of $2^0$, $2^1$, $2^2$, $2^3$, $2^4$, $2^5$, $2^6$ and $2^7$, respectively. These subfields are combined to realize 256 gray-scale in a TV field of an AC PDP.

The reset period makes the wall charge accumulated on each of the whole cells substantially equal. In order to accomplish this, the reset period erases previous image information, thereby making the initial condition of the whole cells equal, before writing new image information. The address period following the reset period has a function of selecting each of the cells whether to be turned on or off. It accomplishes this by forming a positive wall charge on the scan electrode and a negative wall charge on the address electrode of the selected cells to be turned on. The wall charges are formed by a discharge between the scan electrode Y and the address electrode A intersecting at each cell. During the sustain period following the address period, a sustain voltage lower than the firing voltage is applied between the scan electrode Y and sustain electrode X. Thus, sustain discharges can be fired and maintained only in those cells turned on during the address period. In other words, only those cells with a wall charge accumulates on the sustain electrode can continue the sustain discharge after the aforementioned address period.

For driving the AC PDP during the sustain period, high voltage pulses are applied alternately to the panel capacitance. Generally, in the driving circuit of an AC PDP, the energy recovery driving circuit is employed. This circuit increases the efficiency of the system by recovering the energy in the panel capacitance. In addition, it helps to reduce noise due to an electromagnetic interference (EMI), and makes the driving of the sustain period stable and efficient.

There have been numerous efforts to improve the energy efficiency of the AC PDP, but the low energy efficiency is still a major problem. A very low percentage of the total electric power consumed in the AC PDP is actually converted into useful visible photons. The vast majority of energy is consumed during the sustain period. The majority of the current flowing into an AC PDP is the current flowing through the panel capacitance at the time of discharge firing.

SUMMARY OF THE INVENTION

The present invention has been made in an effort to solve the above problem of the low energy efficiency in the AC PDP.

It is an object of the present invention to provide a charge-controlled driving circuit, which limits the current flowing into the PDP after discharge firing, thus to improve energy efficiency.

This invention provides an improved technology in which a capacitor is charged first, before charging the panel capacitance. Then, by turning on a switch installed between the capacitor and the panel capacitance, the panel capacitance is charged indirectly. By limiting the current flowing into the panel capacitance in this manner, the energy efficiency can be improved. In addition, the switch can control the ramping rate independently and the driving can be performed with about half of the power supply voltage required in conventional driving circuits.

To achieve the above object, the present invention provides a circuit for driving an AC plasma display panel having a panel capacitance during the sustain period, the driving circuit comprising: a storage capacitor; charging means for providing a path of charge-flow when turned on, the charging means being connected to the storage capacitor; a resonance inductor that is connected to the charging means; an intermediate capacitor, connected to the resonance inductor to accomplish LC resonance with the inductor, wherein the intermediate capacitor is charged up to at least a sustain voltage as a result of the LC resonance; switching means, connected between the intermediate capacitor and the panel capacitance, which turns on after the intermediate capacitor is charged to at least the sustain voltage so that the charge stored in the intermediate capacitor is transferred to the panel capacitance and the sustain discharge is fired; and wherein the amount of the current flowing into the panel during the sustain period is limited because it is supplied from the limited charge stored in the intermediate capacitor.

In another aspect, the present invention provides a circuit for driving an AC plasma display panel having a panel capacitance during the sustain period, the driving circuit comprising: a voltage source; a first switch, connected to the voltage source, for providing a path for charge supply of the voltage source when turned on; a storage capacitor, connected to the first switch, for storing the charge supplied from the voltage source when the first switch is turned on; charging means, connected to the storage capacitor, for transferring the charge stored in the storage capacitor to the panel; a resonance inductor, connected between the charging means and the panel capacitance, for applying the sustain voltage to the panel capacitance as a result of a LC resonance; and wherein the amount of the current flowing into the panel during the sustain period is limited because it is supplied from the limited charge stored in the storage capacitor through the inductor.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

Preferred embodiments of the present invention will now be described in detail, with reference to the accompanying drawings.

Figure 1A:
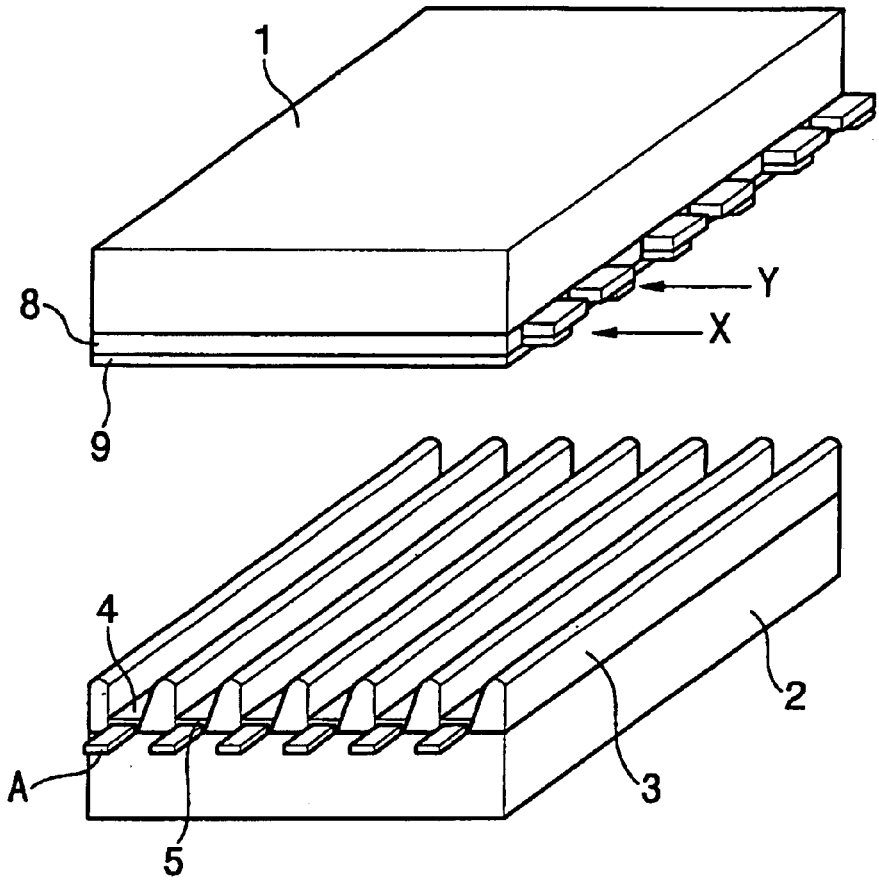
FIG. 1a (Prior Art)
FIG. 1*a* shows an exemplary panel structure of a conventional AC PDP.
Figure 1B:
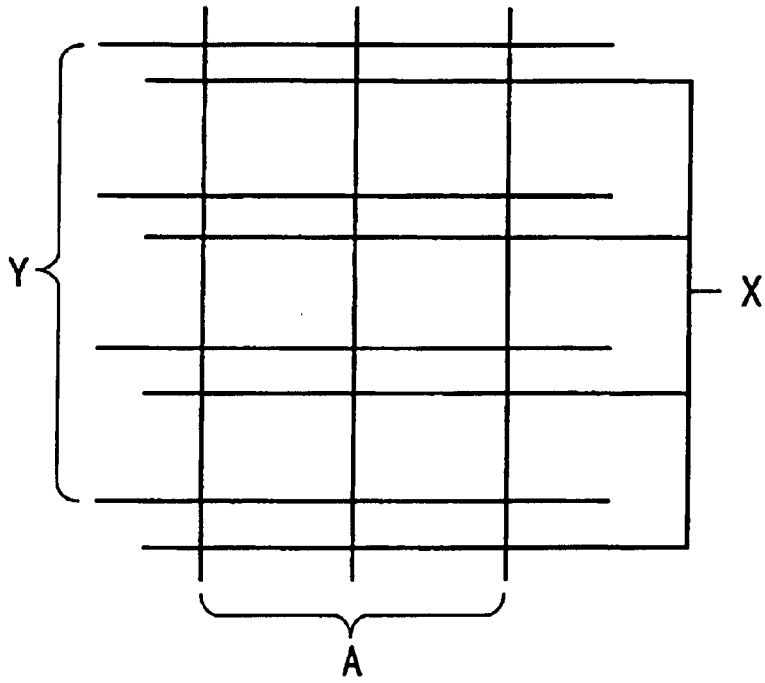
FIG. 1b (Prior Art)
FIG. 1*b* is a diagram illustrating an arrangement of electrodes in the AC PDP.
Figure 2:
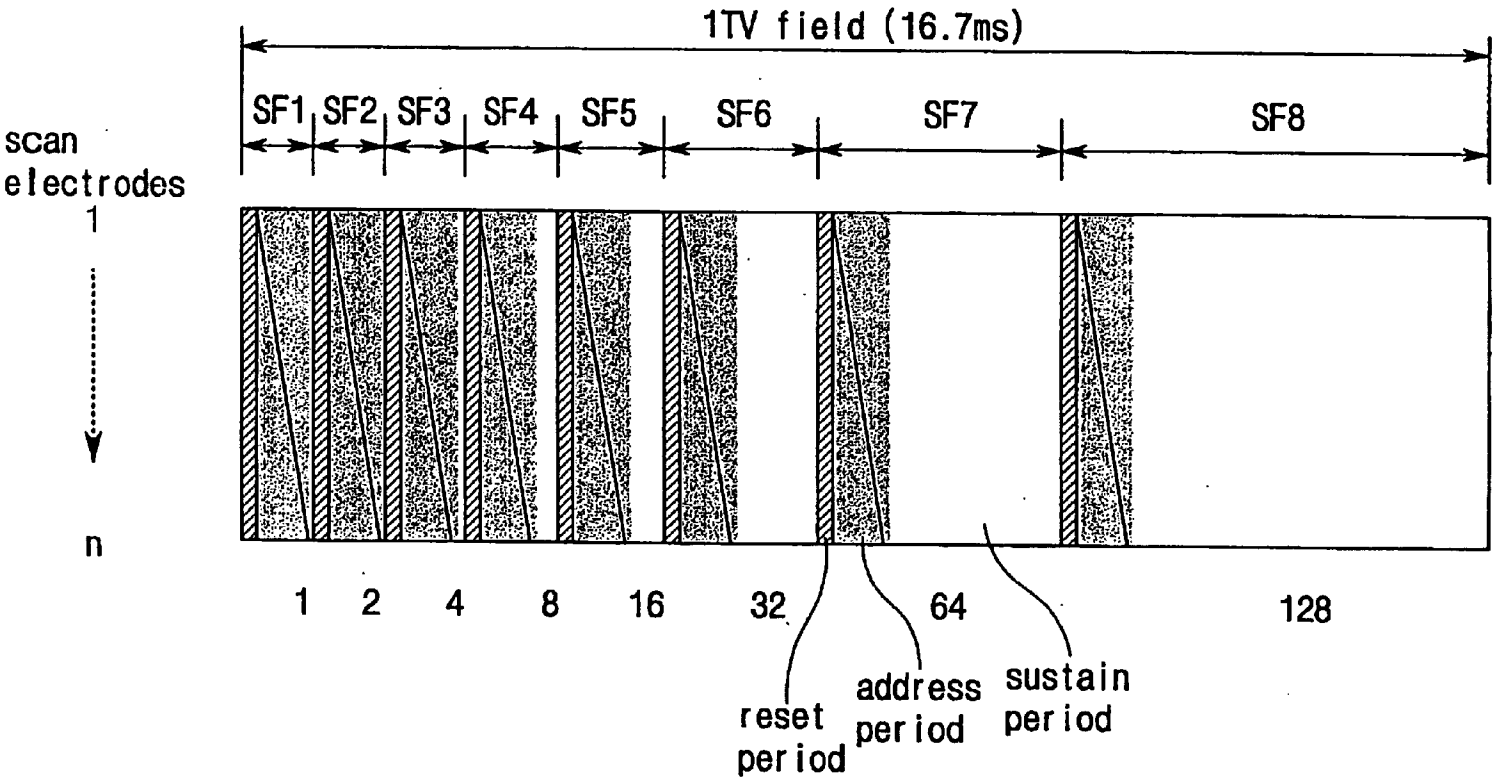
FIG. 2 shows a TV field divided into eight subfields to realize 256 gray-scale as an example of the multiple intensity level displaying technique of the AC PDP.
Figure 3:
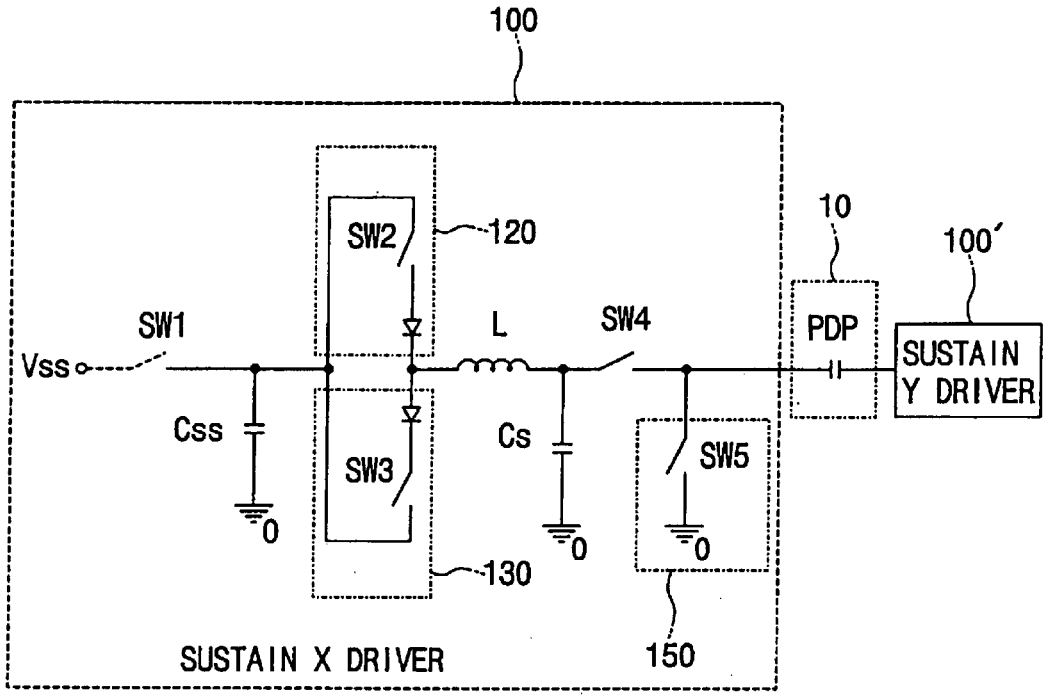
FIG. 3 shows a first preferred embodiment of the charge-controlled driving circuit of this invention.

FIG. 3 shows a schematic diagram of a preferred embodiment of the present invention. A driving circuit 100 of the present invention is for driving an AC PDP 10 during the sustain period, and as shown in FIG. 1*b*, the AC PDP 10 has a plurality of parallel sustain electrodes X and scan electrodes Y. During the sustain period, a sustain voltage is applied between the sustain electrodes X and the scan electrodes Y, so that the sustain discharge is fired in the cells selected during the address period. For this purpose, as shown in FIG. 3, it is common to have the driving circuits 100 and 100' which supplies the sustain voltage installed at the both ends of the PDP 10 symmetrically. Various modifications in the arrangement of the driving circuits 100 and 100' are also possible.

As shown in FIG. 3, a preferred driving circuit 100 of the present invention comprises a storage capacitor Css, an intermediate capacitor Cs, a resonance inductor L, a charging part 120, and a switch SW4.

The operation of the circuit for charging the panel capacitance is explained in detail below. The storage capacitor Css is a source that supplies charge to the panel capacitance. In addition, the storage capacitor Css restores the charge recovered from the panel capacitance. First, the storage capacitor Css is connected to the voltage source Vss through a first switch SW1 and is charged with more than half of the minimum sustain voltage. Next, the charge in the storage capacitor Css is transferred into the intermediate capacitor Cs through the resonance inductor L following the charging switch SW2 in the charging means 120 being turned on. By LC resonance of the resonance inductor L and the intermediate capacitor Cs, the intermediate capacitor Cs is charged to the voltage about twice as much as the voltage source Vss. Then, by turning on the switching means SW4, the intermediate capacitor Cs is connected to the panel and supplies the charge to the panel capacitance. As the panel capacitance is charged, the voltage across the panel capacitance increases and, consequently, the sustain discharge is fired. Using the driving circuit of the invention, once discharge has begun, the supply of charge is limited by the charge stored in the intermediate capacitor Cs. Accordingly, the excessive flow of discharge current is limited, thereby, increasing the energy efficiency.

Besides, for operation of the circuit during the decrease of the voltage across the panel, the charge recovery means 130 and the clamping means 150 should be further included. The operation of the circuit during the decrease of the voltage across the panel is described below. After the sustain discharge is completed, by turning on the charge recovering switch SW3 in the charge recovery means 130, the charge stored in the panel capacitance is recovered to the storage capacitor Css through the resonance inductor L. At this time, the clamping switch SW5 included in the clamping means 150 is turned on and the voltage of the side of the panel is grounded.

Figure 4:
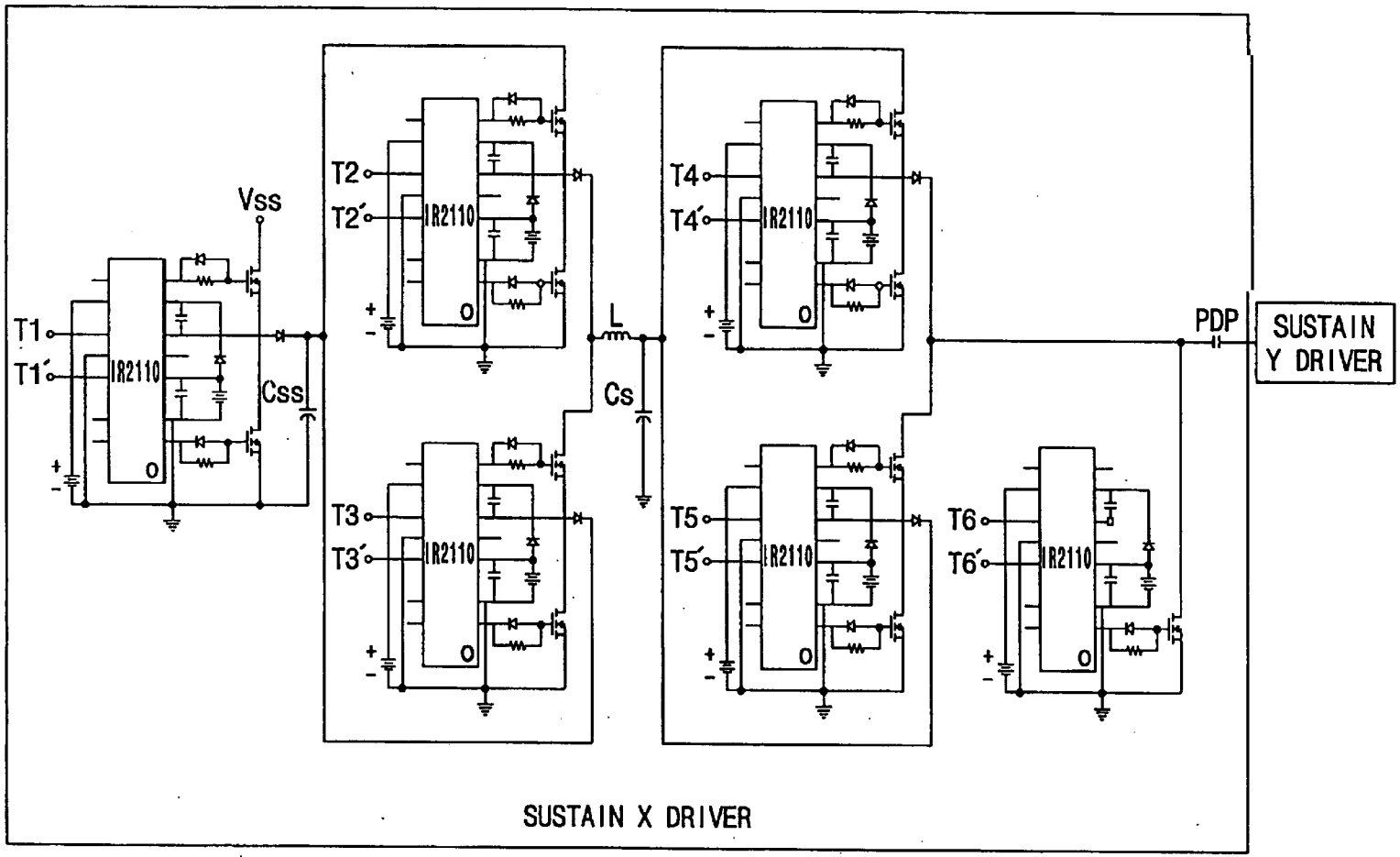
FIG. 4 shows a first example of the driving circuit diagram in which the present invention is implemented.

FIG. 4 shows an example of realization of the driving circuit using the actual devices. This is just an example and is not intended to limit the invention only to this particular example. The experiment using the circuit shown in FIG. 4, which includes about the same number of devices as in the conventional driving circuit, showed that the circuit increased power efficiency by limiting the current during the sustain period. In addition, it was observed that for the circuit to perform ideally, the capacitance of the intermediate capacitor Cs should be above a certain critical value depending on the panel capacitance. Furthermore, by adjusting the ratio of the capacitance of the intermediate capacitor Cs to the panel capacitance, it is possible to control the amount of discharge current.

FIG. 3 and FIG. 4 show one of the most important characteristics of this invention. In the conventional circuit, after charging the panel capacitance to the sustain voltage, the panel capacitance is disconnected from the LC resonance circuit and is connected to a voltage source using a switch, to keep a constant sustain voltage being supplied to the panel capacitance. Thus, the panel capacitance is initially charged through a LC resonance circuit. After the panel capacitance has been charged, in the event that it is continuously connected to the LC resonance circuit, it is impossible to keep the sustain voltage constant while the panel discharges. Accordingly, in the conventional method, after the voltage across the panel is increased to the sustain voltage by the LC resonance action, the LC resonance circuit is disconnected from the panel and a voltage source is connected to the panel.

However, in the present invention, the intermediate capacitor Cs is first charged and then the intermediate capacitor Cs supplies charge to the panel capacitance. The characteristic feature of the invention is that, in this driving circuit and method, charge is supplied to the panel from a limited charge source, intermediate capacitor Cs, and thus the voltage across the panel is not kept constant while the panel discharges. Accordingly, in the present invention, it is not necessary to connect a voltage source through a switch to the panel to maintain the sustain voltage during the sustain discharge.

In relation to the characteristic feature of the present invention mentioned above, a voltage source Vss, which is connected to the storage capacitor Css and charges the capacitor, is needed in the preferred embodiment of the present invention. After the storage capacitor Css is charged using the voltage source Vss, it charges the intermediate capacitor Cs through the LC resonance circuit. Thus, if the storage capacitor Css is charged above a half of the sustain voltage using the voltage source Vss, the voltage across the intermediate capacitor Css can be above the sustain voltage, because the voltage can be doubled by an effect of the resonance circuit. While the conventional circuit requires a power source supplying a higher voltage than the sustain voltage, the embodiment of the present invention requires a voltage source supplying a higher voltage than half of the sustain voltage.

In the circuit and method of the present invention as described above, power efficiency can be highly improved using the charge-controlled driving circuit by limiting the current flowing into the PDP after the beginning of discharge.

At the time of charging, the intermediate capacitor is charged first. Then, by turning on the switch provided between the intermediate capacitor and panel, the panel capacitance is charged by transferring of the charge stored in the intermediate capacitor. Therefore, the current flowing into the panel is limited in the present invention. In addition, the switch can control the ramping rate of the voltage across the panel independently. Further, the charge-controlled driving circuit of the present invention can be used to drive the PDP with a voltage source of only about half of the voltage needed in the conventional circuit.

Figure 5:
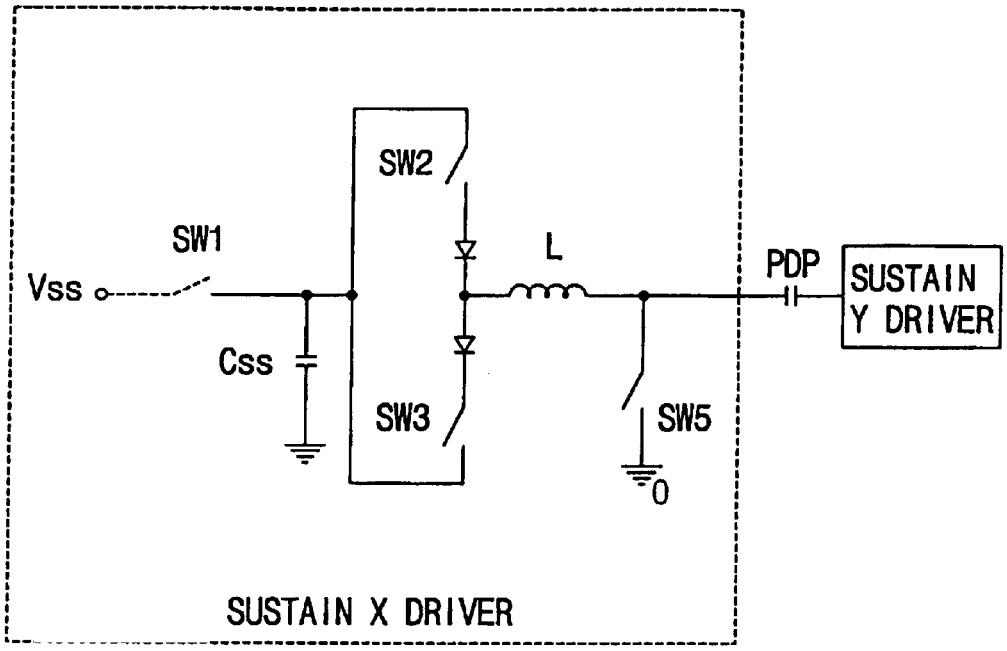
FIG. 5 shows a second preferred embodiment of the charge-controlled driving circuit of this invention.
Figure 6:
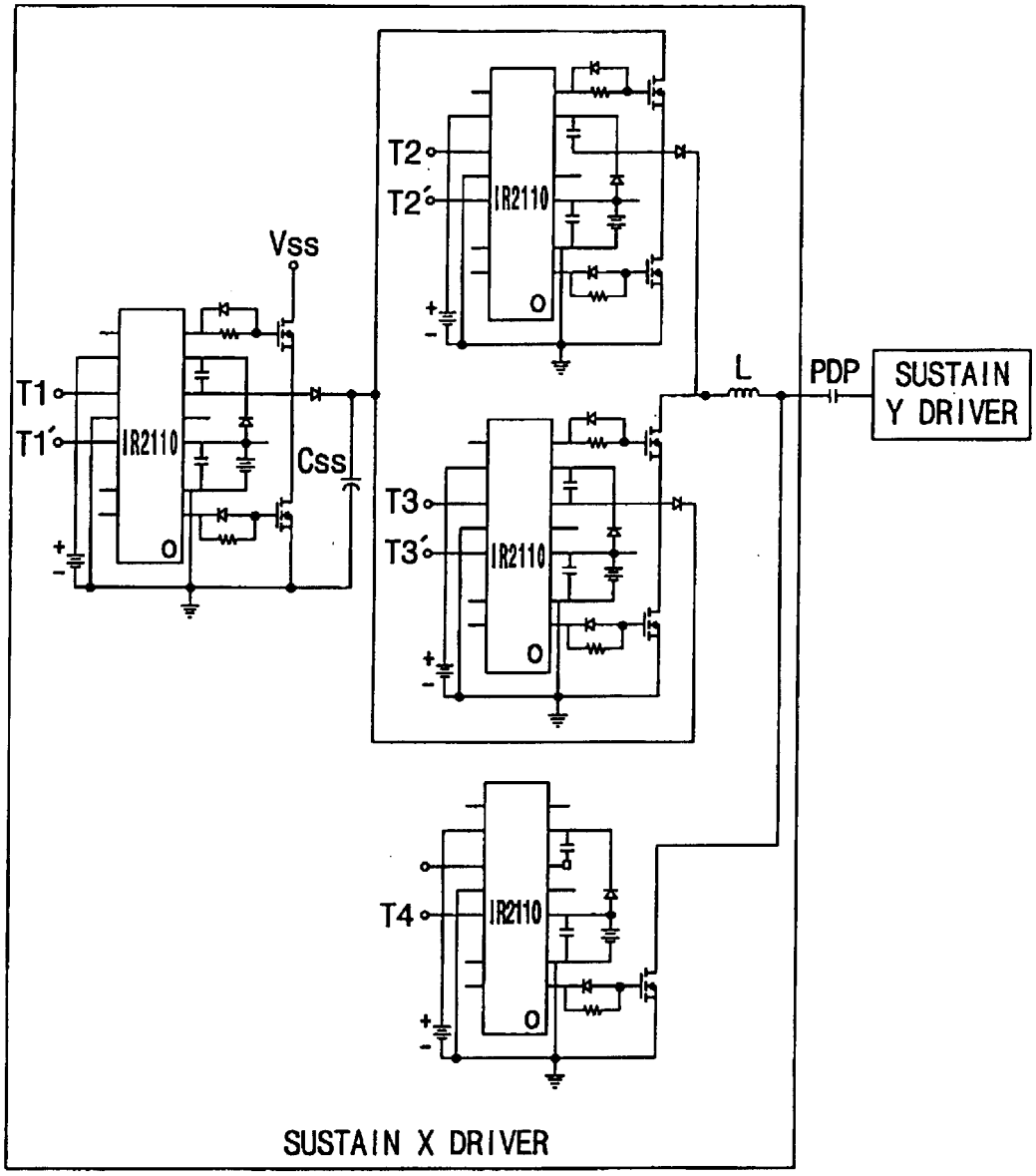
FIG. 6 shows a second example of the driving circuit diagram in which the present invention is implemented.

FIG. 5 and FIG. 6 show a second preferred embodiment of the charge-controlled driving circuit of this invention and a second example of the driving circuit diagram in which the present invention is implemented, respectively. In the second embodiment, the amount of the current flowing into the panel during the sustain period is limited because it is supplied from the limited charge stored in the storage capacitor.

The objective of the embodiments and drawings is to clearly explain the present invention and does not limit the technical concept of the invention. The present invention described above can be replaced, modified and changed by one skilled in the art, as long as such changes do not exceed the technical scope of the invention. Therefore, the invention is not limited by the embodiments and drawings; and the claims should be included in consideration of the invention.

What is claimed is:

1. A circuit for driving an AC plasma display panel having a panel capacitance during a sustain period, the driving circuit comprising:

a storage capacitor;

charging means for providing a path of charge-flow when turned on, the charging means being connected to said storage capacitor;

a resonance inductor that is connected to the charging means;

an intermediate capacitor, connected to the resonance inductor to accomplish LC resonance with the inductor, wherein the intermediate capacitor is charged up to at least a sustain voltage as a result of the LC resonance;

switching means, connected between the intermediate capacitor and the panel capacitance, which turns on after the intermediate capacitor is charged to at least the sustain voltage so that the charge stored in the intermediate capacitor is transferred to the panel capacitance and the sustain discharge is fired; and wherein the amount of the current flowing into the panel during the sustain period is limited because it is supplied from the limited charge stored in the intermediate capacitor.

2. The circuit of claim 1, further comprising:

discharging means, connected between the storage capacitor and the resonance inductor, for providing a path of charge-recovery from the panel capacitance to the storage capacitor; and clamping means for maintaining the voltage of the panel capacitance at a grounded level after the charge is recovered back to the storage capacitor.

3. The circuit of claim 1, wherein the charging means comprises:

a charging switch connected to the storage capacitor; and a charging diode, connected between the charging switch and the resonance inductor, directing a current from the storage capacitor to the resonance inductor.

4. The circuit of claim 2, wherein the discharging means comprises:

a discharging switch connected to the storage capacitor; and a discharging diode, connected between the discharging switch and the resonance inductor, directing a current from the resonance inductor to the storage capacitor.

5. The circuit of claim 1, wherein the amount of the charge stored in the intermediate capacitor is much enough to make the charged voltage of the intermediate capacitor at least the sustain voltage.

6. The circuit of claim 1, wherein the voltage of the storage capacitor because of the pre-charging is at least a half of the sustain voltage.

7. The circuit of claim 1, wherein a ramping rate of the voltage across the panel can be controlled by the switching means.

8. A circuit for driving an AC plasma display panel having a panel capacitance during a sustain period, the driving circuit comprising:

a voltage source;

a first switch, connected to the voltage source, for providing a path for charge supply of the voltage source when turned on;

a storage capacitor, connected to the first switch, for storing the charge supplied from the voltage source when the first switch is turned on;

charging means, connected to the storage capacitor, for transferring the charge stored in the storage capacitor to the panel;

a resonance inductor, connected between the charging means and the panel capacitance, for applying a sustain voltage to the panel capacitance as a result of an LC resonance; and wherein the amount of the current flowing into the panel during the sustain period is limited because it is supplied from the limited charge stored in the storage capacitor through the inductor.

9. The circuit of claim 8, further comprising:

discharging means, connected between the storage capacitor and the resonance inductor, for providing a path of charge-recovery from the panel capacitance to the storage capacitor; and clamping means for maintaining the voltage of the panel capacitance at a grounded level after the charge is recovered back to the storage capacitor.

10. The circuit of claim 9, wherein the discharging means comprises:

a discharging switch connected to the storage capacitor; and a discharging diode, connected between the discharging switch and the resonance inductor, directing a current from the resonance inductor to the storage capacitor.

11. The circuit of claim 8, wherein the charging means comprises:

a charging switch connected to the storage capacitor; and a charging diode, connected between the charging switch and the resonance inductor, directing a current from the storage capacitor to the resonance inductor.

12. The circuit of claim 8, wherein the amount of the charge stored in the intermediate capacitor is much enough to make the charged voltage of the intermediate capacitor at least the sustain voltage.

13. The circuit of claim 8, wherein the voltage of the storage capacitor because of the pre-charging is at least a half of the sustain voltage.

14. The circuit of claim 8, wherein a ramping rate of the voltage across the panel can be controlled by the switching means.

15. A method for driving an AC plasma display panel having a panel capacitance during the sustain period, using a driving circuit comprising a storage capacitor, charging means for providing a path of charge-flow when turned on, the charging means being connected to said storage capacitor, a resonance inductor that is connected to the charging means, an intermediate capacitor, connected to the resonance inductor to accomplish LC resonance with the inductor, wherein the intermediate capacitor is charged up to at least the sustain voltage as a result of the LC resonance, switching means, connected between the intermediate capacitor and the panel capacitance, which turns on after the intermediate capacitor is charged to at least the sustain voltage so that the charge stored in the intermediate capacitor is transferred to the panel capacitance and the sustain discharge is fired, the driving method comprising:

controlling the charging means to transfer the charge stored in the storage capacitor to the intermediate capacitor and thus to charge the intermediate capacitor to at least the sustain voltage as a result of the LC resonance;

controlling the switching means to transfer the charge stored in the intermediate capacitor to the panel capacitance and thus to fire the sustain discharge; and wherein the amount of the current flowing into the panel during the sustain period is limited because it is supplied from the limited charge stored in the intermediate capacitor.

16. A method for driving an AC plasma display panel having a panel capacitance during the sustain period, using a driving circuit comprising a voltage source, a first switch, connected to the voltage source, for providing a path for charge supply of the voltage source when turned on, a storage capacitor, connected to the first switch, for storing the charge supplied from the voltage source when the first switch is turned on, charging means, connected to the storage capacitor, for transferring the charge stored in the storage capacitor to the panel, a resonance inductor, connected between the charging means and the panel capacitance, for applying a sustain voltage to the panel capacitance as a result of an LC resonance, the driving method comprising:

turning on the first switch to charge the storage capacitor to the source voltage;

controlling the charging means to transfer the charge stored in the storage capacitor to the panel capacitance via the resonance inductor, and thus to fire the sustain discharge; and wherein the amount of the current flowing into the panel during the sustain period is limited because it is supplied from the limited charge stored in the storage capacitor through the inductor.

* * * * *